United States Patent [19]

Muchmore

[11] Patent Number: 4,885,809

[45] Date of Patent: Dec. 12, 1989

[54] PORTABLE POCKET SPITTOON

[76] Inventor: Charles H. Muchmore, P.O. Box 17245, St. Bernard, Ohio 45217

[21] Appl. No.: 339,011

[22] Filed: Apr. 14, 1989

Related U.S. Application Data

[63] Continuation-in-part of Ser. No. 147,439, Jan. 25, 1988, abandoned.

[51] Int. Cl.[4] ..... A61J 19/00

[52] U.S. Cl. ..... 4/259; 4/274; 215/1 C; 220/94 A; D9/380

[58] Field of Search ..... 4/258, 259, 267, 274; 215/1 C; 220/94 A; D9/378, 380, 383; D24/47

[56] References Cited

U.S. PATENT DOCUMENTS

| | | | |
|---|---|---|---|
| 630,225 | 8/1899 | Hodgerney | 4/259 |
| 743,226 | 11/1903 | Beyer et al. | 4/259 |
| 829,687 | 8/1906 | Bean | 4/259 |
| 907,875 | 12/1908 | Pritchard | 4/259 |
| 1,072,695 | 9/1913 | Brotherton | 4/259 |
| 1,518,302 | 12/1924 | Bulla | 4/259 |
| 1,647,427 | 11/1927 | Andrews | 4/259 |
| 1,680,151 | 8/1928 | Kauffman | 4/259 |
| 2,852,054 | 9/1958 | Motley | 215/1 C |
| 3,152,710 | 10/1964 | Platte | 215/1 C |
| 4,162,547 | 7/1979 | Jenkins | 4/259 |
| 4,712,698 | 12/1987 | Greenberg | 215/100 A |

FOREIGN PATENT DOCUMENTS

| | | | |
|---|---|---|---|
| 134216 | 12/1928 | Switzerland | 4/259 |

*Primary Examiner*—Charles E. Phillips

[57] ABSTRACT

The portable pocket spittoon is a flesh colored bottle shaped object made with FDA approved plastic material. It will be manufactured by using the blow molding method, currently used in making other similar plastic objects.

The portable pocket spittoon has an original and unique hand grip design that projects a completely different profile from anything on today's market. The lid is hinged to help prevent dropping and spilling it. Due to the hand grip and hinged lid, the tobacco chewer can use it to spit into periodically during the course of a chew.

The portable pocket spittoon is intended to be used with one hand. Its purpose is to permit the tobacco chewer to accomplish what has been very difficult to do in the past. It will permit the chewer to chew very discreetly and eliminate the unsightly viewing of a person spewing tobacco juice openly.

As stated eariler, two objects defined in the dictionary describe the portable pocket spittoon. Those objects are, the "bottle" and the "spittoon". This means that the portable spittoon could be classified as being a new and useful improvement over old objects, that is, both the "bottle" and the "spittoon".

3 Claims, 1 Drawing Sheet

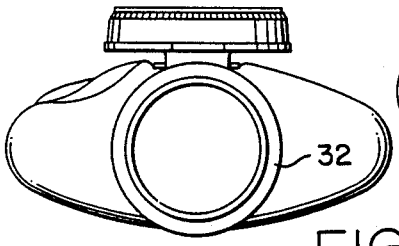
FIG. 7
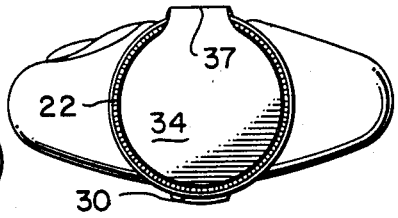
FIG. 5
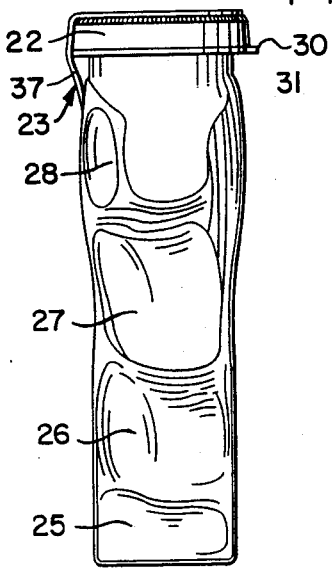
FIG. 2
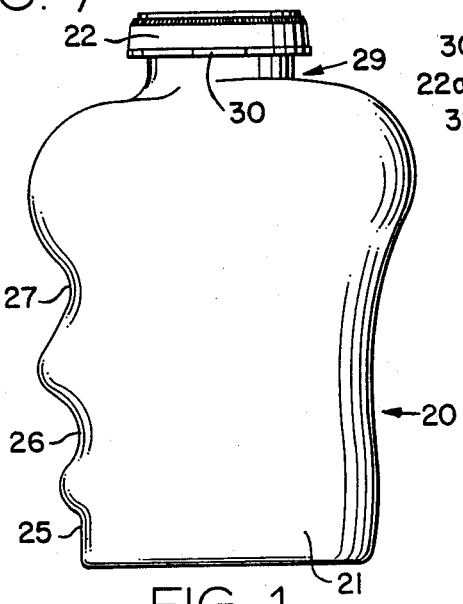
FIG. 1
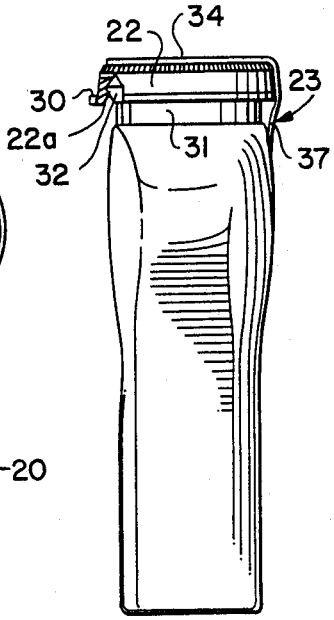
FIG. 3
FIG. 4
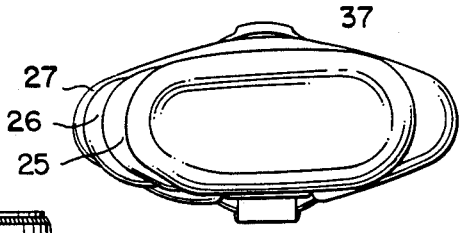
FIG. 6
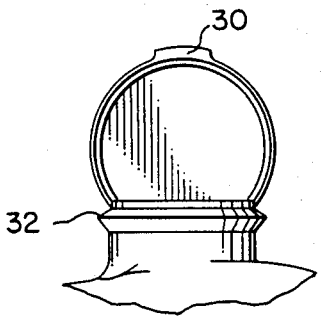
FIG. 9
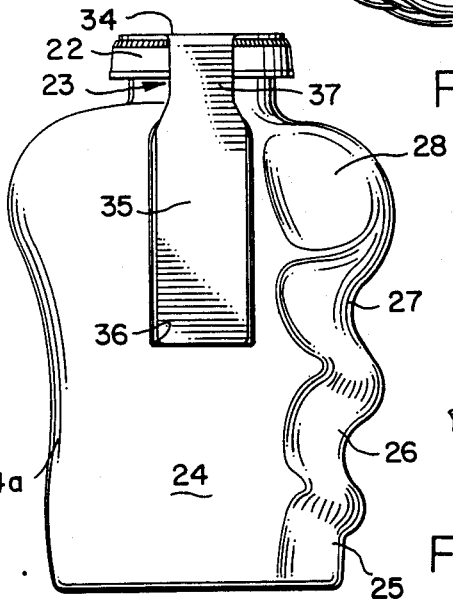
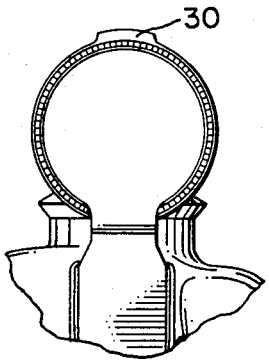
FIG. 10
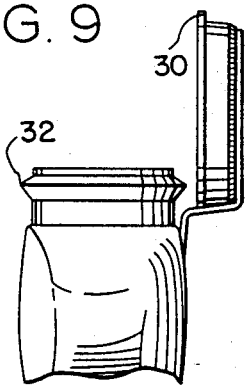
FIG. 8

PORTABLE POCKET SPITTOON

This is a continuation-in-part of my co-pending application Ser. No. 07/147,439 filed Jan. 25, 1988 now abandoned.

BACKGROUND OF THE INVENTION

This invention is directed to portable, pocket, tobacco spittoon that is an improvement over spittoons known heretofore.

Spittoons are well known in the form of cups, pots and the like exposed on the floor of a room or the like in public view and which users often miss, are considered unsanitary and offensive by many segments of the public, with the result that those having need of disposing of excessive juice often find none available. This invention pertains to an improved spittoon which is portable in the user's pocket for discreet use when needed and without display of an ugly stream of tobacco juice.

SUMMARY

An object of my invention is to provide a spittoon that is a self-contained single unit that may be held in and manipulated by one hand and used discreetly without displaying an ugly stream of tobacco juice while held in the hand which largely screens the spittoon and tobacco juice stream from the view of by-standers.

Another object of my invention is to provide a portable spittoon having finger grooves shaped and sloped downward to permit the fingers to push downward while pushing upwards with the thumb to open the lid.

A further object of my invention is to provide a portable, pocket, spittoon having finger grooves to afford the holding hand a grip that provides confidence against accidentally dropping the spittoon.

Another object of my invention is to provide a spittoon of the above kind having a precision molded neck and cooperating lid which afford a leakproof seal between them when the lid is snapped in place in closing relation on the neck.

The spittoon of my invention is preferably approximately the size of a pack of cigarettes and has smooth flowing lines which not only may be gripped as above described, but make the spittoon simple and easy to put in the user's shirt pocket and just as easy to remove it from the pocket.

Another object of my invention is to provide a flexible hinge having one end portion attached to the lid, an opposite end portion attached to the body of the spittoon and a connecting portion joining said end portions and when the user raises the lid, flexible and twistable to permitting position of said lid to render usage of the spittoon more discreet.

Another object of the invention is to provide a pocket spittoon which may be blow-molded of FDA approved high density polyethelene plastic so as to be simple, sanitary, inexpensive, mass producible, carriable in the pocket for personal use.

THE PRIOR ART

When chewing tobacco or dipping snuff, it is necessary to periodically dispose of excessive saliva. Normally the chewer is obliged to use unsightly cups or cans and the public finds this objectionable. There is a need for a portable pocket spittoon that is inexpensive, sanitary, portable, for individual use, easy to use and that can be used in a discreet way as avoids public notice and public objection. Other spittoons and containers have been proposed, such as cuspidors and cans disclosed in U.S. Pat. Nos. 630225, 743226, 829687, 907875, 1072695, 1518302, 1647427, 2852054, 3152710 and 4162547. The foregoing and other prior art cuspidors and containers do not present the design, the hinge or the capabilities of the invention presented herein. None of the foregoing patents have the built-in grip design, permanently attached flexible hinge and cap all in my pocket spittoon.

The above and other objects and features of the invention will be apparent to those skilled in the art to which this invention pertains from the following detailed description and the drawings.

BRIEF DESCRIPTION OF THE DRAWINGS

FIG. 1 is a view in front elevation of the preferred embodiment of my invention in portable pocket spittoons;

FIG. 2 is a view in side elevation of the spittoon shown in FIG. 1 viewed from the left of FIG. 1;

FIG. 3 is a view in side elevation, partly in section, of the spittoon shown in FIG. 1 viewed from the right of FIG. 1;

FIG. 4 is a rear view in elevation of the spittoon shown in FIG. 1;

FIG. 5 is a top plan view of the spittoon shown in FIG. 1;

FIG. 6 is a bottom plan view of the spittoon shown in FIG. 1;

FIG. 7 is a top plan view of the spittoon similar to FIG. 5, but with the lid in open upright position;

FIG. 8 is a fragmentary view of the spittoon similar to FIG. 3, but with the lid in open upright position;

FIG. 9 is a fragmentary view in front elevation with the lid in open upright position;

FIG. 10 is a fragmentary view in rear elevation with the lid in open upright position.

DESCRIPTION OF THE PREFERRED EMBODIMENT

FIGS. 1, 2, 3, 4, 5 and 6 illustrate the preferred embodiment of this invention in portable pocket spittoons wherein it is generally indicated at 20. The spittoon has a body 21, a lid 22 and a flexible hinge 23.

The front 21 has form fitting indentations for the four fingers of the user's hand and the rear face 24 and side face **24*a* form a continuous surface of the body of generally convex configuration that fits in the palm of the user's right hand while the hand is wrapped around the body of the spittoon in a firm secure grip. The user's little finger fits in indentation 25, the finger next to the user's little finger fits in indentation 26, the finger adjacent the user's index finger fits in indentation 27, the index finger fits in indentation 28 and the thumb of the user fits in the indentation 29 between the upper part of the body 21 and the lid 22. Thus, when the user grasps the body of the portable pocket spittoon, the fingers in indentations 26 and 27 hold the body 21 against movement upward or downward relative to the gripping hand, while the finger in indentation 25 holds the body against downward movement, and the finger in indentation 28 holds against upward movement. The palm adjacent the base of the thumb also engages an upward surface of the body and thereby resists upward movement of the body relative to the hand while the outer end portion of the thumb is positioned to engage the release tab 30 projecting from the edge of the lid opposite the hinge 23. The thumb need only push up on the lid tab 30 to disengage the lip 22***a* of lid 22 from beneath the sealing flange 32 annularly of the mouth 33 in the neck 31 of the body.

The hinge 23, which may be fabricated of Mylar or other strong flexible material, has a round disk shape portion 34 which is adhesively firmly secured to the top of the lid 22 as shown in FIGS. 1–5, 7, 8 and 10, and a rectangular portion 35 which is adhesively secured in recess 36 in the rear face 24 of the body 21. The central portion 37 of hinge 23 is integral with portions 34,35 and joins them together. As hinge portion 37 is thinner as viewed in edge view in FIGS. 2, 4 and 8, and broad as viewed in FIGS. 4, 5, 7 and 10, it is more flexible about lines transversely of the broad face of 37 as viewed in FIG. 4.

When the user desires to use the pocket spittoon 20, it is grasped in the right hand with the front (as viewed in FIG. 1) facing the user. The thumb pushes up on release tab 30 to release the lid from sealing engagement with flange 32 and swing it into an upright position as shown in FIGS. 7–10, in which the thumb extends upwardly to the right of the lid as viewed in FIG. 9 and to the left of the lid as viewed in FIG. 10 so as to complement the screening by the lid, of the user's mouth and the discharge of tobacco juice into the spittoon. Additionally, the index finger of the user substantially obscures the neck 31, also contributes to the screening of the user's mouth and tobacco juice discharge into the spittoon, from the view of by-standers in front of the user using the spittoon. Use of the portable pocket spittoon involves by one hand manipulation, placing the open mouth of the spittoon at the pursed lips of the user so accidental dropping or spilling of liquid intended for the spittoon is avoided. When not in use, the lid may be snapped closed, with the lid lip 22*a* engaging sealing flange 32 thereby sealing the spittoon which may then be conveniently carried in a pocket of a shirt, jacket or the like until needed again by the user.

This invention has been described in its presently contemplated best mode, and it is clear that it is susceptible to numerous modifications, modes and embodiments within the ability of those skilled in the art and without exercise of the inventive faculty. Accordingly, the scope of this invention is defined by the scope of the following claims.

What is claimed is:

1. A handheld, portable, pocket sized spittoon comprising a container having two opposed side walls connected by two opposed end walls and opposed bottom and top walls, said top wall having an opening therein to provide a passageway for spitting, said spittoon being constructed of plastic and having a plastic cap hingedly connected thereto and snap-fitted onto said opening, one of the said two opposed side walls and one of the said end walls having four finger grip depressions therein, extending one above the other, the uppermost depression consisting of a depression to accommodate the end of an index finger while the remaining depressions allow the other fingers of one hand to wrap around the one said opposed end wall when the thumb is engaging the other of said side walls, the snap-cap having a tab thereon extending above the other of said opposed side walls such that when the user desires with the fingers in place as described above upward pressure may be applied on said tab by the thumb to disengage said cap from said opening while engagement of said depressions by the fingers holds said spittoon firmly.

2. A spittoon as set forth in claim 1 wherein said lid is hingedly attached to said one of said two opposed side walls.

3. A spittoon as set forth in claim 2 wherein said hinge consists of a round portion adhesively attached to said cap and a rectangular portion extending from said round portion, said rectangular portion being adhesively attached to said one of said two opposed side walls.

* * * * *